US010669679B2

(12) United States Patent
Nelson et al.

(10) Patent No.: US 10,669,679 B2
(45) Date of Patent: Jun. 2, 2020

(54) GROUND STRIPER PUMP PISTON HAVING DUAL CHECKS

(71) Applicant: Graco Minnesota Inc., Minneapolis, MN (US)

(72) Inventors: Andrew Nelson, Brooklyn Park, MN (US); Dennis Dingmann, Blaine, MN (US); Mike Flander, Elk River, MN (US); James C. Schroeder, Ramsey, MN (US); Peter Thomassen, Kinrooi (BE)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 16/284,729

(22) Filed: Feb. 25, 2019

(65) Prior Publication Data

US 2019/0264401 A1 Aug. 29, 2019

Related U.S. Application Data

(60) Provisional application No. 62/635,112, filed on Feb. 26, 2018.

(51) Int. Cl.

| | |
|---|---|
| ***E01C 23/22*** | (2006.01) |
| ***B05B 9/04*** | (2006.01) |
| ***B05B 13/00*** | (2006.01) |
| ***F04B 7/00*** | (2006.01) |
| ***F04B 7/02*** | (2006.01) |
| ***F04B 15/02*** | (2006.01) |
| ***F04B 23/02*** | (2006.01) |
| ***F04B 23/06*** | (2006.01) |
| ***F04B 5/02*** | (2006.01) |
| ***F04B 53/12*** | (2006.01) |

(Continued)

(52) U.S. Cl.

CPC ..... *E01C 23/222* (2013.01); *B05B 9/0413* (2013.01); *B05B 13/005* (2013.01); *E01C 23/22* (2013.01); *F04B 5/02* (2013.01); *F04B 7/0003* (2013.01); *F04B 7/0266* (2013.01); *F04B 13/02* (2013.01); *F04B 15/02* (2013.01); *F04B 23/025* (2013.01); *F04B 23/06* (2013.01); *F04B 53/1005* (2013.01); *F04B 53/126* (2013.01)

(58) Field of Classification Search

CPC ..... B05B 13/005; E01C 23/22
USPC ..... 404/93, 111; 417/440
See application file for complete search history.

(56) References Cited

U.S. PATENT DOCUMENTS

| | | | |
|---|---|---|---|
| 980,050 | A | 12/1910 | Black |
| 1,432,658 | A | 10/1922 | Bellar |

(Continued)

FOREIGN PATENT DOCUMENTS

| | | | |
|---|---|---|---|
| FR | 2328864 | A1 | 5/1977 |
| WO | WO2016085288 | A1 | 6/2016 |

OTHER PUBLICATIONS

Extended European Search Report for EP Application No. 19159505.7, dated Jul. 23, 2019, pp. 8.

*Primary Examiner* — Gary S Hartmann
(74) *Attorney, Agent, or Firm* — Kinney & Lange, P.A.

(57) ABSTRACT

A pump for a striping machine includes dual check valves within its piston. At least one of the dual check valves is closed during an upstroke of the piston, thereby ensuring that the pump drives fluid during both its upstroke and its downstroke to maintain a desired ratio between a fluid output by the pump and a material solution output by another pump of the striping machine.

19 Claims, 4 Drawing Sheets

(51) Int. Cl.
*F04B 53/10* (2006.01)
*F04B 13/02* (2006.01)

(56) References Cited

U.S. PATENT DOCUMENTS

| | | | | |
|---|---|---|---|---|
| 2,308,876 | A | 1/1943 | Hammett | |
| 2,367,893 | A | 1/1945 | Sheen | |
| 2,891,571 | A | 6/1959 | Sparks | |
| 2,909,123 | A | 10/1959 | Jennings, Jr. | |
| 3,140,667 | A | 7/1964 | Anderson et al. | |
| 3,220,351 | A | 11/1965 | Kling | |
| 3,380,247 | A | 4/1968 | Colmerauer | |
| 3,661,167 | A | 5/1972 | Hussey | |
| 3,684,410 | A * | 8/1972 | Fitzgerald | F04B 53/126 417/554 |
| 3,918,845 | A | 11/1975 | Heard | |
| 4,018,247 | A | 4/1977 | Carr | |
| 4,253,524 | A | 3/1981 | Erickson | |
| 4,534,715 | A | 8/1985 | Jones | |
| 4,596,515 | A | 6/1986 | Simon et al. | |
| 4,607,660 | A | 8/1986 | Bennitt | |
| 5,971,715 | A | 10/1999 | Breslin | |
| 7,051,813 | B2 * | 5/2006 | Hayes | E21B 34/14 166/332.1 |
| 7,690,899 | B2 * | 4/2010 | Harada | B60T 8/4031 417/254 |
| 8,226,386 | B2 | 7/2012 | Cifuentes | |
| 9,033,688 | B2 * | 5/2015 | Kowalchuk | E21B 43/127 137/533.11 |
| 9,188,203 | B2 | 11/2015 | Crump | |
| 9,890,780 | B2 * | 2/2018 | Kowalchuk | E21B 43/127 |
| 10,087,590 | B2 * | 10/2018 | Lins | E01C 23/22 |
| 10,456,801 | B2 * | 10/2019 | Horning | F04B 15/023 |
| 2005/0082065 | A1 | 4/2005 | Hayes et al. | |

* cited by examiner

GROUND STRIPER PUMP PISTON HAVING DUAL CHECKS

CROSS-REFERENCE TO RELATED APPLICATION(S)

This application claims the benefit of U.S. Provisional Application No. 62/635,112 filed Feb. 26, 2018 for "PUMP PISTON HAVING DUAL CHECKS," the disclosure of which is hereby incorporated in its entirety.

BACKGROUND

The present disclosure relates to piston pumps, and in particular pumps utilized to apply stripes to ground surfaces, such as roadways, parking lots, and tarmacs.

Ground marking can be accomplished with a polymer-based lines. The polymer-based lines are more durable than conventionally painted lines. In some cases, the polymer-based lines are thermally applied to the ground surface. In other cases, a plasticizing material is mixed with a catalyst prior to application to the ground surface. The catalyst then evaporates, leaving a polymer stripe on the ground surface. The ratio between the catalyst and the plasticizing material must be maintained at a desired level, generally with a much higher level of plasticizing material than catalyst, to ensure that the line has the desired properties, such as thickness, width, reflectivity, color, etc. The plasticizing material and the catalyst are driven by two separate pumps. To maintain the desired ratio the pump driving the catalyst typically has a significantly smaller displacement, and thus smaller component parts, than the other pump. However, the catalyst can cause sticking of the components, such as the springs of the valves within the pumps, thereby causing the catalyst pump to stick in an open state.

SUMMARY

According to one aspect of the disclosure, a striping machine configured to apply striping material to a ground surface includes a frame, at least one wheel supporting the frame, a dispenser configured to apply a spray of the material to the ground surface, a first reservoir supported on the frame and configured to store a first component material, and a first pump configured to pump the first component material from the first reservoir to the dispenser. The first pump includes a cylinder, a piston configured to reciprocate within the cylinder, a first check valve disposed within the piston, and a second check valve disposed within the piston.

According to another aspect of the disclosure, a pump for a striping machine includes a piston configured to reciprocate along a pump axis; an internal channel extending axially through the piston and configured to provide a flowpath through the piston form an upstream chamber to a downstream chamber the internal channel comprising a plurality of bores disposed coaxially on the pump axis; a first check valve disposed in a first bore of the plurality of bores; and a second check valve disposed in a second bore of the plurality of bores.

According to yet another aspect of the disclosure, a method includes reciprocating a piston through an upstroke and a downstroke along a pump axis; drawing, by reciprocation of the piston, fluid into a pumping chamber disposed upstream of the piston during the upstroke of the piston, the fluid flowing into the pumping chamber through an upstream check valve; driving, by reciprocation of the piston, fluid from the pumping chamber to a downstream chamber disposed on a downstream side of the piston during the downstroke, the fluid flowing through an internal channel extending through the piston and through each of a first check valve and a second check valve disposed within the internal channel; and driving, by reciprocation of the piston, fluid out of the downstream chamber and through a pump outlet during both the upstroke and the downstroke of the piston. At least one of the first check valve and the second check valve is in a closed state during the upstroke of the piston.

DETAILED DESCRIPTION

Figure 1:
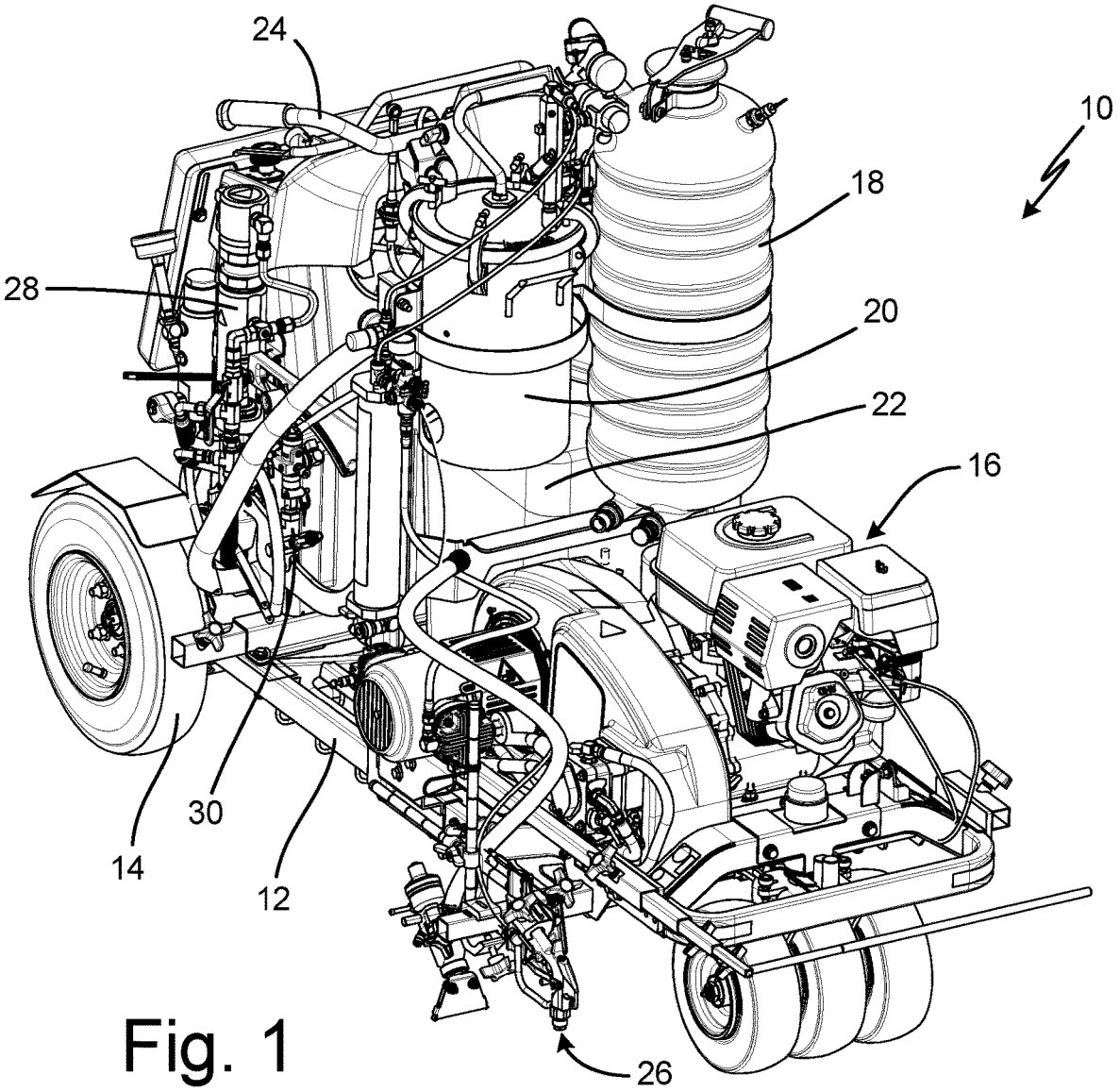
FIG. 1 is an isometric view of a striper.

FIG. 1 is an isometric view of striper 10. Striper 10 includes frame 12, wheels 14, motor 16, bead tank 18, pressure pot 20, reservoir 22, controls 24, nozzle 26, main pump 28, and secondary pump 30. Striper 10 is used to apply stripes and other patterns of a marking material on ground surfaces. Striper 10 can be used to apply road and parking lot markings, among other applications.

Frame 12 is a structure, for example a metal structure, on which various components of striper 10 are mounted. Wheels 14 are connected to frame 12 and support frame 12 and other components of striper 10 as striper 10 traverses the ground and applies the marking material. Motor 16 is supported by frame 12. Motor 16 is configured to supply power, such as mechanical power and/or electrical power (e.g., via an alternator) to various modules of striper 10. Motor 16 can be a gas combustion engine; however, any suitable type of motor 16 can be utilized to provide power to the components of striper 10. In some examples, motor 16 can be one or more batteries for supplying electrical power to operate striper 10.

Controls 24 are supported by frame 12 and are configured to be utilized by an operator to control operation of striper 10. Controls 24 can include one or more of handle bars for steering striper 10; one or more buttons for controlling striper 10; one or more pedals for managing self-propulsion of striper 10; one or more buttons and/or levers for inputting one or more commands into striper 10 such as spray commands; and/or one or more dials, lights, and/or screens for receiving information output from striper 10, amongst other options.

Bead tank 18, pressure pot 20, and reservoir 22 are each supported, either directly or indirectly, by frame 12. Bead tank 18 is configured to hold a supply of material for application to increase the reflectivity of the stripes, such as glass beads. Reservoir 22 is configured to hold a supply of marking material prior to application by striper 10. Pressure pot 20 is configured to store a catalyst or other material utilized to generate the stripes.

Nozzle 26 is supported by frame 12 and is configured to apply a spray of marking material to the ground surface. As such, nozzle 26 is a dispenser of striper 10. Striper 10 can include one nozzle 26 or more than one nozzle 26. Main pump 28 is fluidly connected to reservoir 22 and is configured to drive material from reservoir 22 to nozzle 26. Secondary pump 30 is fluidly connected to pressure pot 20 and is configured to drive material from pressure pot 20 to nozzle 26.

Striper 10 can be utilized for applying polymer-based lines, which can be particularly durable as compared to conventionally painted lines. The polymer lines in this case can be formed by application of a resin, such as methyl methacrylate (MMA). An MMA solution is stored in reservoir 22. Reservoir 22 is a tank supported on frame 12. The MMA solution is pumped from reservoir 22 by main pump 28 and is ultimately dispensed from nozzle 26 as a spray on the ground. The MMA solution is mixed with a catalyst to promote fast drying upon being sprayed. The catalyst can be, for example, benzoyl peroxide (BPO). The catalyst is stored in pressure pot 20. The catalyst is drawn from pressure pot 20 by secondary pump 30. The outputs of main pump 28 and secondary pump 30 are mixed upstream of nozzle 26 before being sprayed from nozzle 26. After the MMA solution is sprayed, reflective beads from bead tank 18 can be blown onto the deposited MMA stripe. The beads can be embedded into the drying MMA to increase the reflectivity of the applied stripe.

Main pump 28 is a reciprocating piston pump that is hydraulically actuated by a hydraulic pump or motor onboard striper 10. Secondary pump 30 is also a reciprocating piston pump that is slaved by a mechanical link to main pump 28 to reciprocate in phase with the piston of main pump 28. For example, a yoke mechanism can connect main pump 28 and secondary pump 30. Main pump 28 and secondary pump 30 reciprocate together to maintain a proper ratio of MMA solution to catalyst. For example, the MMA solution is ideally dispensed in a mixture of about 2% catalyst. Therefore, the main pump 28 and secondary pump 30 pump in synchrony to output a 98:2 ratio of MMA to BPO. While main pump 28 is shown as being hydraulically driven, it is understood that main pump 28 can be driven in any desired manner, such as pneumatically or electrically.

Figure 2A:
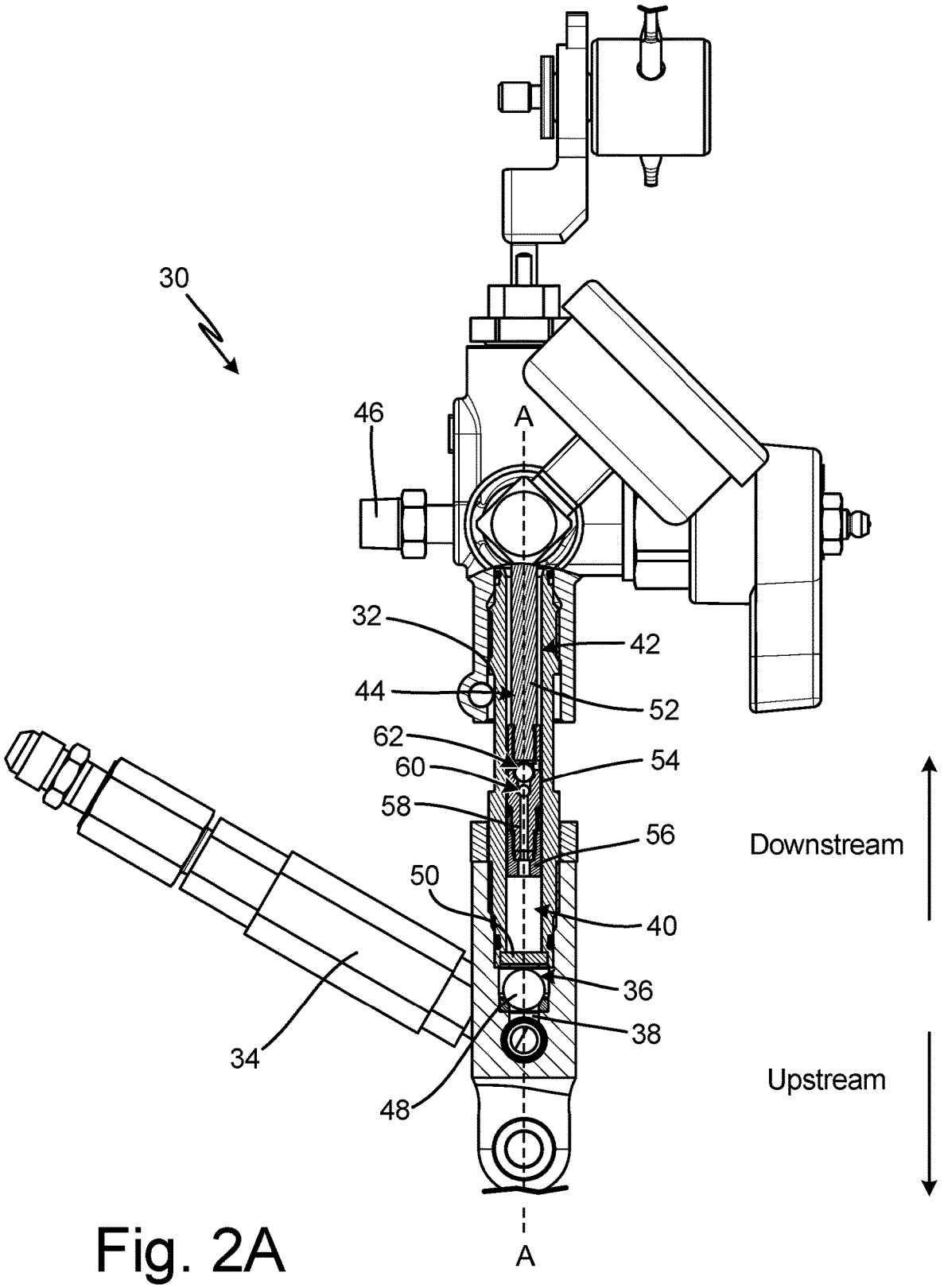
FIG. 2A is a partial cross-sectional view of a pump.
Figure 2B:
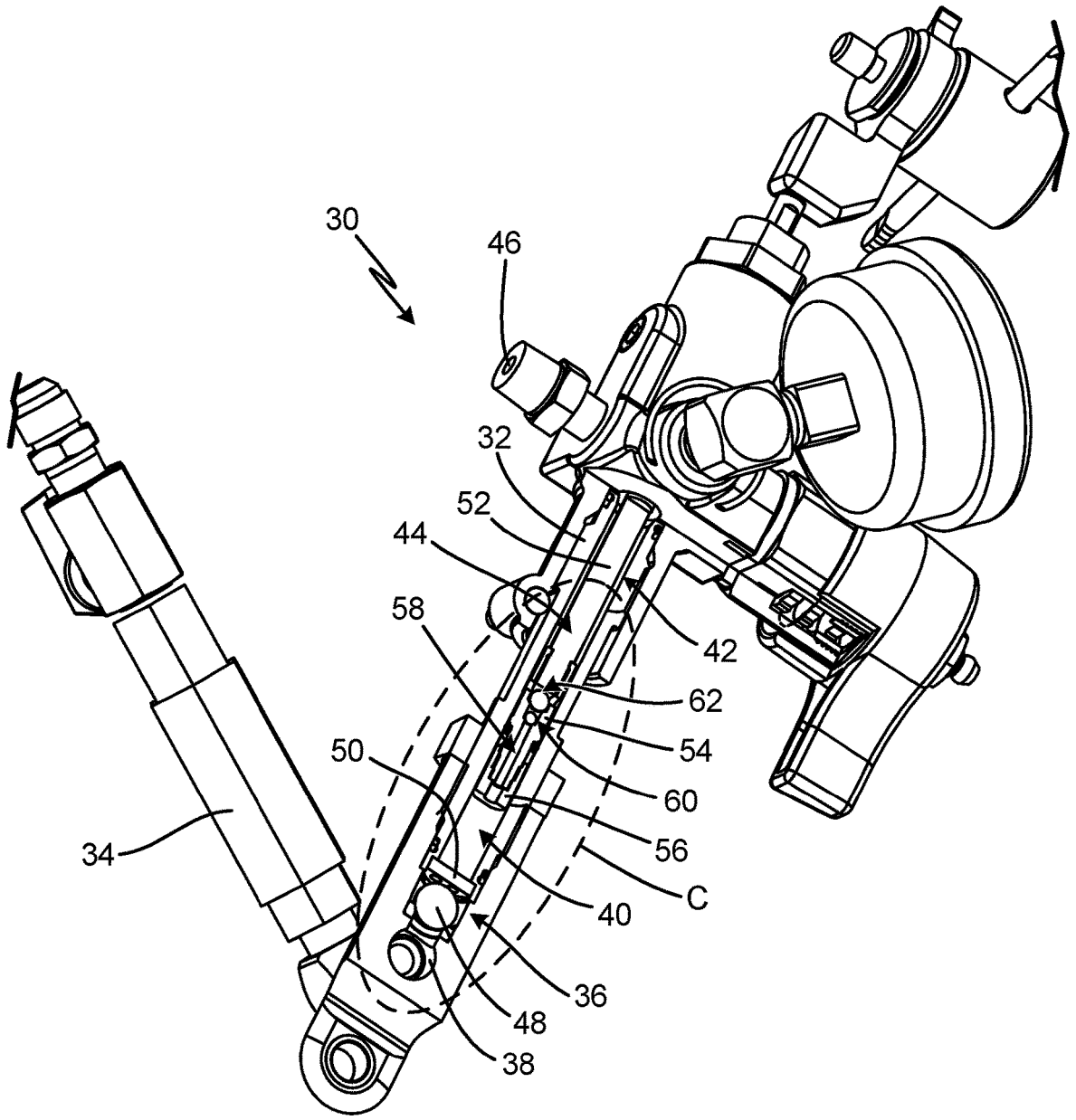
FIG. 2B is an isometric, cross-sectional view of a pump.
Figure 2C:
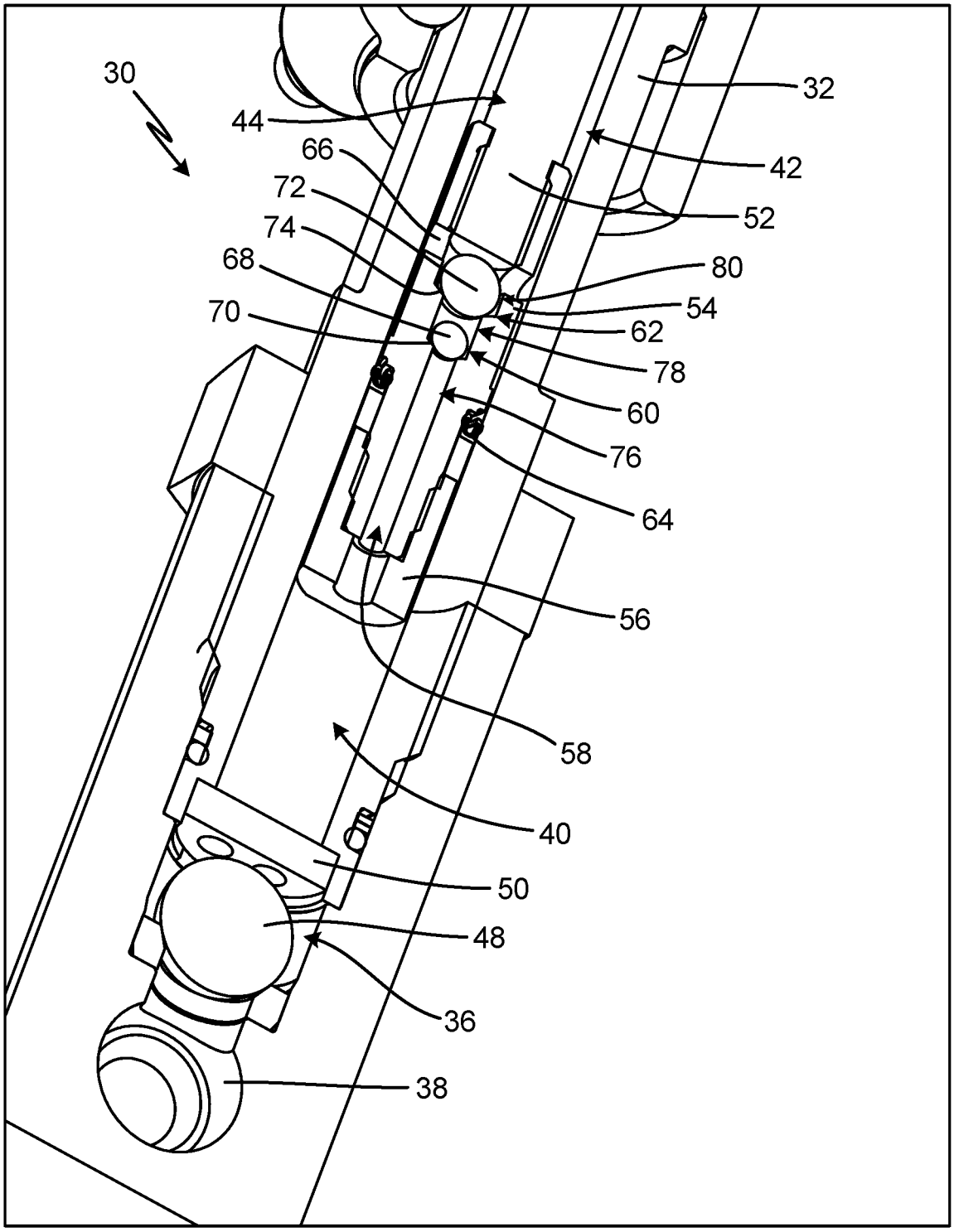
FIG. 2C is an enlarged view of detail C in FIG. 2B.

FIG. 2A is a cross-sectional view of secondary pump 30. FIG. 2B is a cross-sectional perspective view of secondary pump 30. FIG. 2C is an enlarged view of detail C in FIG. 2B. Secondary pump 30 includes cylinder 32, inline check valve 34, upstream check valve 36, upstream chamber 38, pumping chamber 40, downstream chamber 42, piston 44, and outlet 46. Upstream check valve 36 includes upstream ball 48 and ball stop 50. Piston 44 includes piston rod 52, piston body 54, piston face 56, internal channel 58, first check valve 60, second check valve 62, and dynamic seal 64. Piston body 54 includes ports 66. First check valve 60 includes first ball 68 and first shoulder 70. Second check valve 62 includes second ball 72 and second shoulder 74. Internal channel 58 includes first bore section 76, second bore section 78, and third bore section 80.

Piston 44 extends into cylinder 32 and is configured to reciprocate within cylinder 32 along pump axis A-A (shown in FIG. 2A). Inline check valve 34 is connected to secondary pump 30 and is configured to provide fluid (e.g., BPO solution) to upstream chamber 38. The fluid flowing into upstream chamber 38 encounters upstream check valve 36. As shown, upstream check valve 36 can be a ball and seat-type valve; however, other types of check valves can also be used. In the illustrated embodiment, ball stop 50 limits the downstream extent of travel of upstream ball 48 of upstream check valve 36. As shown in FIG. 2B, ball stop 50 includes flow holes to allow the fluid to pass through ball stop 50. After passing through ball stop 50, the fluid enters pumping chamber 40.

Pumping chamber 40 is formed within cylinder 32. Piston 44 reciprocates within cylinder 32 to pump the fluid. As shown, piston rod 52, piston body 54, and piston face 56 are separate components that are fixed (e.g., by threading) to each other. It is understood, however, that in various other embodiments two or all of these components could be formed from a contiguous piece instead of being separate components joined together.

Internal channel 58 extends through piston 44 to provide a flowpath for the fluid to flow from pumping chamber 40 to downstream chamber 42. Internal channel 58 extends through piston face 56 and piston body 54. Internal channel 58 is open on the upstream end of the piston face 56. Internal channel 58 continues through piston body 54 from the upstream end of piston face 56. Internal channel 58 extends through piston body 54 and is in fluid communication with ports 66 in piston body 54. Downstream chamber 42 is defined by a gap between the outer circumference of piston 44 and the inner circumference of cylinder 32. Fluid is expelled from ports 66 into the downstream chamber 42 and is then output through outlet 46 of secondary pump 30. Dynamic seal 64 is disposed around piston body 54 and separates pumping chamber 40 from downstream chamber 42.

Piston 44 pumps the fluid by reciprocating on piston axis A-A. During a downstroke of piston 44, the fluid within pumping chamber 40 is forced into internal channel 58. Fluid already within internal channel 58 (e.g., from a prior stroke) is forced downstream by the incoming fluid and through ports 66 and then out of outlet 46 of secondary pump 30. During the downstroke, upstream check valve 36 prevents fluid from backflowing out of pumping chamber 40 to inline check valve 34. On the upstroke of piston 44, additional fluid is drawn from upstream (e.g., through the inline check valve 34) into pumping chamber 40. The fluid flows through the inline check valve 34, upstream chamber 38, and upstream check valve 36 and into pumping chamber 40. Also, during the upstroke, fluid already within internal channel 58 is likewise forced through ports 66 and then out of outlet 46 of secondary pump 30. This is because the volume of downstream chamber 42 decreases during the upstroke, such that piston body 54 forces the fluid downstream out of downstream chamber 42 through outlet 46. Piston 44 thereby causes secondary pump 30 to operate as a double acting pump in that secondary pump 30 pumps fluid through outlet 46 on both the upstroke and the downstroke of piston 44. Such double action is facilitated by first check valve 60 and second check valve 62 disposed within and along internal channel 58, as further discussed herein.

As best seen in FIG. 2C, first check valve 60 and second check valve 62 are located within piston 44. First check valve 60 and second check valve 62 are located along internal channel 58 and are disposed within piston 44. As shown, first check valve 60 and second check valve 62 are disposed within piston body 54. As such, each of first check valve 60 and second check valve 62 can be located within a single part, such as a single metallic part. First check valve 60 and second check valve 62 are each disposed within internal channel 58, such that first check valve 60 and second check valve 62 are disposed along a common flowpath.

First check valve 60 is formed by first ball 68 and first shoulder 70, with first shoulder 70 serving as a seat for first ball 68. Second check valve 62 is formed by second ball 72 and second shoulder 74, with second shoulder 74 serving as a seat for second ball 72. As shown, internal channel 58 widens (in the downstream direction) to form first shoulder 70 as a seat for first ball 68 and widens further downstream to form second shoulder 74 as a seat for second ball 72. Each of first shoulder 70 and second shoulder 74 can be formed within a single part, which single part can be metallic.

Internal channel 58 includes multiple bore sections having differing diameters to facilitate first check valve 60 and second check valve 62. Internal channel 58 includes a first, upstream bore section 76 having a first diameter. Internal channel 58 widens to form first shoulder 70, such that a second bore section 78 of internal channel 58 is formed downstream of the first bore section 76. The second bore section 78 has a second diameter larger than the first diameter. As such, first shoulder 70 provides a transition from the diameter of first bore section 76 to the diameter of second bore section 78. Internal channel 58 widens further downstream to form second shoulder 74, such that a third bore section 80 of internal channel 58 is formed downstream from each of the first bore section 76 and the second bore section 78. The third bore section 80 has a diameter larger than the second bore section 78. As such, second shoulder 74 provides a transition from the diameter of second bore section 78 to the diameter of third bore section 80.

Each of first check valve 60 and second check valve 62 are located along internal channel 58 in different bores having different sizes. In some examples, internal channel 58 does not narrow between the various bore sections, such that second shoulder 74 does not prevent first ball 68 from passing downstream past second shoulder 74 into the third bore section 80.

First ball 68 is configured to engage first shoulder 70 with first check valve 60 in a closed state, and second ball 72 is configured to engage with second shoulder 74 with second check valve 62 in a closed state. As shown, first shoulder 70 and second shoulder 74 are integrally formed with piston body 54 such that they are formed by the same material which forms piston body 54. It is understood, however, that seat rings (e.g., formed by carbide) can instead be inserted along internal channel 58 to interface and seal with first ball 68 and second ball 72, similar to the seat of upstream check valve 36.

First ball 68 has a smaller diameter than second ball 72. In some examples, the diameter of first ball 68 can be 3 millimeters while the diameter of second ball 72 can be 5 millimeters. As such, the ratio of the diameter of first ball 68 to the diameter of second ball 72 can be about 3:5. First shoulder 70 has a first seat diameter and second shoulder 74 has a second seat diameter. The first seat diameter is smaller than the second seat diameter. In examples where first check valve 60 and second check valve 62 include seat rings, it is understood that the seat rings can also be of differing diameters.

Neither of first check valve 60 and second check valve 62 include springs. The downstream side of piston rod 52 serves as a downstream travel stop for second ball 72. Second ball 72 serves as a downstream travel stop for first ball 68.

First check valve 60 and second check valve 62 are inline and coaxial. More specifically, first ball 68 and second ball 72 as well as first shoulder 70 and second shoulder 74 are coaxial. Each of first check valve 60 and second check valve 62 reciprocate along with piston 44.

Piston 44 provides significant benefits. One benefit of the dual first check valve 60 and second check valve 62 within piston 44 is ensuring proper closure of internal channel 58 during the upstroke of piston 44. As mentioned previously, secondary pump 30 is driven in coordination with primary pump 28 (FIG. 1) to ensure a preferred ratio of material to catalyst for spraying. If piston 44 fails to pump on the upstroke, such as where the check valves within piston 44 fail to close, then the targeted ratio (e.g., 98:2) is missed. Conventional check valves include springs to increase ball-seating reliability. However, BPO tends to accumulate on surfaces and tend to interfere with the mechanical operation of small elements such as springs. The double check valve arrangement of piston 44 having no spring disclosed herein is more reliable than a single spring driven check valve. The double check valve arrangement, including first check valve 60 and second check valve 62, provides a greater chance that at least one of first check valve 60 and second check valve 62 will seal on the upstroke. First ball 68 provides a rounded surface to limit the downstream travel of second ball 72, which further decreases the chances of second ball 72 sticking in the open position. In addition, each of first ball 68 and second ball 72 can rotate relative to each other as the fluid is pumped, which further decreases the chances of sticking. Each of first check valve 60 and second check valve 62 operate without a spring. While use of the double check valve piston 44 has been explained for use in ground marking applications, and line striping in particular, it is understood that piston 44 can be used in other applications outside of ground marking.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump comprising:

a piston configured to reciprocate along a pump axis;

an internal channel extending axially through the piston and configured to provide a flowpath through the piston from an upstream chamber to a downstream chamber, the internal channel comprising a plurality of bores disposed coaxially on the pump axis;

a first check valve disposed in a first bore of the plurality of bores, the first check valve including a first ball having a first diameter; and a second check valve disposed in a second bore of the plurality of bores, the second check valve including a second ball having a second diameter larger than the first diameter;

wherein the first ball is disposed upstream of the second ball; and wherein the second ball defines a limit of downstream travel of the first ball, such that the first ball can engage the second ball with the first check valve in an open state.

2. The pump of claim 1, wherein each of the first check valve does not include a spring and the second check valve does not include a spring.

3. The pump of claim 1, wherein:

the piston forms a first shoulder within the internal channel and a second shoulder within the internal channel;

the first shoulder is disposed at an upstream end of the first bore of the plurality of bores, wherein the first shoulder is a first seat of the first check valve, such that the first ball engages the first shoulder with the first check valve in a closed state; and the second shoulder is disposed at a downstream end of the first bore of the plurality of bores and at an upstream end of the second bore of the plurality of bores, wherein the second shoulder is a second seat of the second check valve, such that the second ball engages the second shoulder with the second check valve in a closed state.

4. A striping machine configured to apply striping material to a ground surface, the striping machine comprising:

a frame;

at least one wheel supporting the frame;

a dispenser configured to apply a spray of the material to the ground surface;

a first reservoir supported on the frame and configured to store a first component material; and a first pump configured to pump the first component material from the first reservoir to the dispenser, wherein the first pump is the pump of claim 1.

5. The pump of claim 1, wherein the piston divides the cylinder into a pumping chamber and a downstream chamber, wherein the internal channel is configured to receive fluid from the pumping chamber and provide fluid to the downstream chamber through at least one port configured to discharge fluid from the piston.

6. The pump of claim 5, further comprising:

a third check valve disposed upstream of the piston and configured to control fluid flow into the pumping chamber.

7. The pump of claim 6, wherein the pump is a double displacement pump such that the piston expels fluid into the downstream chamber during each of an upstroke and a downstroke.

8. The pump of claim 1, wherein:

the first bore of the plurality of bores extends from an upstream end of the piston to a first shoulder, the first shoulder forming a first seat with which the first ball is configured to engage;

the second bore of the plurality of bores extends from the first shoulder to a second shoulder, the second shoulder forming a second seat with which the second ball is configured to engage; and the plurality of bores includes a third bore extending from the second shoulder to at least one port configured to discharge fluid from the piston.

9. The pump of claim 1, wherein the piston further comprises:

a piston rod extending into the cylinder and configured to reciprocate along the piston axis;

a piston body mounted to the piston rod; and a piston face mounted to the piston body;

wherein the internal channel extends axially through the piston face and into the piston body; and at least one port configured to discharge fluid from the piston extends through the piston body.

10. The pump of claim 9, wherein the piston body defines a first shoulder within the internal channel and defines a second shoulder within the internal channel, and wherein the first ball is configured to seat on the first shoulder and the second ball is configured to seat on the second shoulder.

11. The striping machine of claim 4, wherein the first check valve and the second check valve do not include springs.

12. The striping machine of claim 4, further comprising:

a second reservoir supported on the frame and configured to store a second component material; and a second pump configured to pump the second component material from the second reservoir to the dispenser;

wherein the first component material and the second component material mix upstream of exiting the dispenser.

13. The striping machine of claim 12, further comprising:

a motor operatively connected to the second pump to power the second pump;

wherein the first pump is mechanically linked to the second pump such that the piston of the first pump reciprocates in phase with a piston of the second pump.

14. A pump comprising:

a piston configured to reciprocate along a pump axis;

an internal channel extending axially through the piston and configured to provide a flowpath through the piston from an upstream chamber to a downstream chamber, the internal channel comprising a plurality of bores disposed coaxially on the pump axis;

a first check valve disposed in a first bore of the plurality of bores, the first check valve including a first ball; and a second check valve disposed in a second bore of the plurality of bores, the second check valve including a second ball;

wherein the first ball is disposed upstream of the second ball;

wherein the internal channel extends through the piston from an upstream end of the piston to at least one port configured to discharge fluid from the piston; and wherein the first check valve and the second check valve are configured to control fluid flow through the internal channel from the upstream end to the at least one port.

15. The pump of claim 14, wherein:

the first check valve is disposed upstream of the second check valve; and the first ball has a smaller diameter than the second ball.

16. The pump of claim 15, wherein the second ball defines a limit of downstream travel of the first ball, such that the first ball can engage the second ball with the first check valve in an open state.

17. A striping machine configured to apply striping material to a ground surface, the striping machine comprising:

a frame;

at least one wheel supporting the frame;

a dispenser configured to apply a spray of the material to the ground surface;

a first reservoir supported on the frame and configured to store a first component material; and a first pump configured to pump the first component material from the first reservoir to the dispenser, wherein the first pump is the pump of claim 14.

18. A pump comprising:

a piston configured to reciprocate along a pump axis;

an internal channel extending axially through the piston and configured to provide a flowpath through the piston from an upstream chamber to a downstream chamber, the internal channel comprising a plurality of bores disposed coaxially on the pump axis;

a first check valve disposed in a first bore of the plurality of bores, the first check valve including a first ball having a first diameter; and a second check valve disposed in a second bore of the plurality of bores, the second check valve including a second ball having a second diameter larger than the first diameter;

wherein the first ball is disposed upstream of the second ball;

wherein the piston forms a first shoulder within the internal channel and a second shoulder within the internal channel;

wherein the first shoulder is disposed at an upstream end of the first bore of the plurality of bores, wherein the first shoulder is a first seat of the first check valve, such that the first ball engages the first shoulder with the first check valve in a closed state; and wherein the second shoulder is disposed at a downstream end of the first bore of the plurality of bores and at an upstream end of the second bore of the plurality of bores, wherein the second shoulder is a second seat of the second check valve, such that the second ball engages the second shoulder with the second check valve in a closed state.

19. A striping machine configured to apply striping material to a ground surface, the striping machine comprising:

a frame;

at least one wheel supporting the frame;

a dispenser configured to apply a spray of the material to the ground surface;

a first reservoir supported on the frame and configured to store a first component material; and a first pump configured to pump the first component material from the first reservoir to the dispenser, wherein the first pump is the pump of claim 18.

* * * * *